US009243415B1

(12) United States Patent
Claeys

(10) Patent No.: US 9,243,415 B1
(45) Date of Patent: Jan. 26, 2016

(54) FLOOR FOR A PORTABLE CONTAINMENT BERM

(71) Applicant: Jay V. Claeys, Bartlesville, OK (US)

(72) Inventor: Jay V. Claeys, Bartlesville, OK (US)

( * ) Notice: Subject to any disclaimer, the term of this patent is extended or adjusted under 35 U.S.C. 154(b) by 0 days.

(21) Appl. No.: 14/448,710

(22) Filed: Jul. 31, 2014

(51) Int. Cl.
*B65D 1/34* (2006.01)
*E04H 6/42* (2006.01)

(52) U.S. Cl.
CPC . *E04H 6/428* (2013.01); *B65D 1/34* (2013.01)

(58) Field of Classification Search
CPC ..... F16N 31/006
USPC ..... 220/573, 560.02, 571; 184/106
See application file for complete search history.

(56) References Cited

U.S. PATENT DOCUMENTS 3,282,381 A * 11/1966 Fitzpatrick ..... A47G 27/0206 184/106
5,128,189 A * 7/1992 Bartlett ..... B32B 1/04 184/106
5,266,378 A * 11/1993 Stephenson ..... B60T 3/00 188/32
5,597,001 A * 1/1997 Rasmussen ..... B08B 3/00 134/104.2
5,928,751 A * 7/1999 Van Romer ..... F16N 31/006 180/69.1
6,120,876 A * 9/2000 Walton ..... F16N 31/006 180/69.1
6,439,492 B1 * 8/2002 Leiggi ..... F16N 31/006 210/924
6,880,721 B1 * 4/2005 Barrett ..... F16N 31/006 220/573
7,634,876 B2 * 12/2009 Moller, Jr. ..... E04F 15/02 404/35
2010/0294779 A1 * 11/2010 Barrett ..... B08B 17/025 220/573
2013/0206251 A1 * 8/2013 Harr ..... F16N 31/006 137/312

* cited by examiner

*Primary Examiner* — Steven A. Reynolds
*Assistant Examiner* — King M Chu
(74) *Attorney, Agent, or Firm* — Frank J. Catalano; Gable Gotwals

(57) ABSTRACT

A floor for a portable containment berm has an intermediate layer of flexible puncture-resistant material sandwiched between lower and upper sheets of flexible impervious material and at least one puncture-resistant and wear-resistant tread pad fixed to the top surface of the upper sheet of flexible impervious material. In one embodiment, the layer of puncture-resistant material and the sheets of impervious material are substantially coextensive and are welded in laminar relationship along their peripheries. In another embodiment, the intermediate layer of flexible puncture-resistant material includes at least two belts of flexible puncture-resistant material with the lower and upper sheets welded in laminar relationship along their peripheries and between each adjacent pair of belts. In either embodiment, the tread pads are welded to the top surface of the upper sheet of flexible impervious material in a configuration suitable to receive the wheels of a vehicle traversing the floor of the berm.

4 Claims, 4 Drawing Sheets

FLOOR FOR A PORTABLE CONTAINMENT BERM

BACKGROUND OF THE INVENTION

This invention relates generally to equipment for handling liquid waste and more particularly concerns portable drive-through berms for containing environmentally hazardous liquids.

Drive-through berms are frequently used to provide secondary containment in areas where other forms of containment are not available, thereby preventing potential spills, leaks, and releases of environmentally hazardous liquids. Because the drive-through berms are portable, they can be deployed and moved to different locations as needed. For example, drive-through berms may be used in large parking lots or equipment storage yards where providing secondary containment around the entire area would be impractical and cost-prohibitive. As another example, vehicles may be temporarily placed on drive-through berms to prevent spills and leaks while the vehicles are serviced or maintained.

Drive-through berms are useful for maintenance, fueling, repair, parking, cargo loading and unloading, and other types of vehicle operations. However, the berms are often placed on surfaces that are uneven, have not been paved, or both. As a result, the berm's floor can be stretched by the weight of the vehicle and any liquid in the berm. This stretching may cause the floor to tear, compromising the integrity of the berm and releasing environmentally hazardous liquids into the environment. Rocks, gravel, twigs, and other debris beneath the berm, as well as small rocks and other materials trapped in the treads of the vehicle's tires, may also cause tears in the berm's floor and secondary containment failure. Prolonged wear, especially if the vehicle tires always contact the same areas of the floor, can also cause berm failure.

It is, therefore, an object of this invention to provide a flexible floor for a portable drive-through containment berm. It is also an object of this invention to provide a puncture-resistant floor for a portable drive-through containment berm.

SUMMARY OF THE INVENTION

In accordance with the invention, a floor for a portable containment berm has a lower sheet of flexible impervious material and an upper sheet of flexible impervious material. An intermediate layer of flexible puncture-resistant material is sandwiched between the lower and upper sheets of flexible impervious material. At least one puncture-resistant and wear-resistant tread pad is fixed to the top surface of the upper sheet of flexible impervious material.

In one embodiment, the intermediate layer of flexible puncture-resistant material is a sheet of flexible puncture-resistant material which is substantially coextensive with the lower and upper sheets of flexible impervious material. The lower, intermediate and upper sheets are welded in laminar relationship along their peripheries. One or more puncture-resistant and wear-resistant tread pads are fixed to the top surface of the upper sheet of flexible impervious material by welding in a configuration suitable to receive the wheels of a vehicle traversing the floor of the berm.

In another embodiment, the intermediate layer of flexible puncture-resistant material includes at least two belts of flexible puncture-resistant material which extend lengthwise in the lengthwise direction of the lower and upper sheets of flexible impervious material. The lower and upper sheets are welded in laminar relationship along their peripheries and between each adjacent pair of belts of flexible puncture-resistant material. One or more puncture-resistant and wear-resistant tread pads extend lengthwise in the lengthwise direction of the belts of flexible puncture-resistant material and are fixed to the top surface of the upper sheet of flexible impervious material by welding in a configuration suitable to receive the wheels of a vehicle traversing the floor of the berm.

BRIEF DESCRIPTION OF THE DRAWINGS

Other objects and advantages of the invention will become apparent upon reading the following detailed description and upon reference to the drawings in which.

Figure 1:
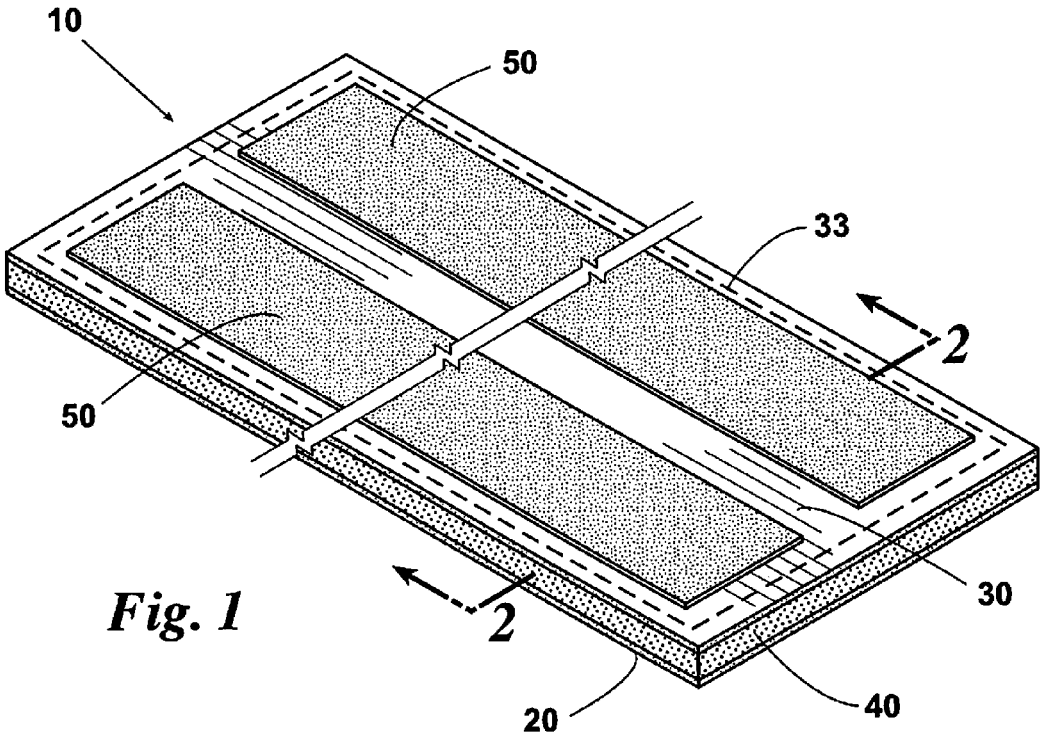
FIG. 1 is a perspective view of one embodiment of the floor of a portable containment berm in accordance with the invention.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Looking at FIGS. 1-6, the floor 10 for a portable containment berm (not shown) includes a lower sheet 20 of a flexible impervious material, an upper sheet 30 also of a flexible impervious material, an intermediate layer 40 of a flexible puncture-resistant material and, as shown, two puncture-resistant and wear-resistant tread pads 50. The tread pads 50 are fixed to the top surface 37 of the upper sheet 30 by welding.

Figure 2:
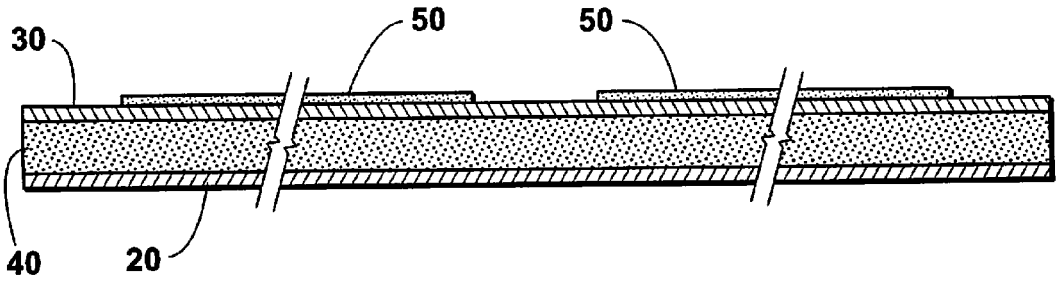
FIG. 2 is cross-sectional view taken along the line 2-2 of FIG. 1.
Figure 3:
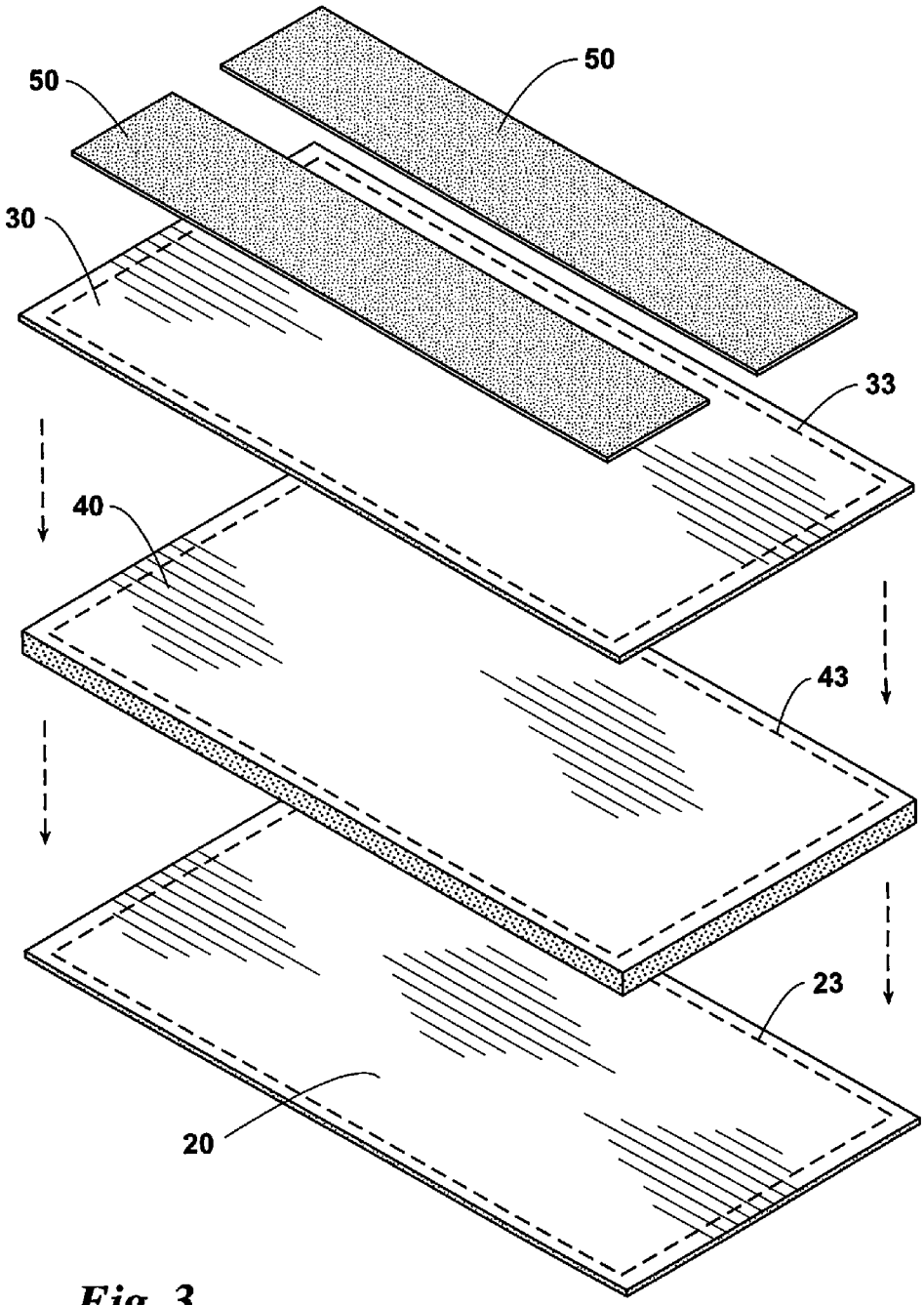
FIG. 3 is a perspective assembly view of the floor of FIG. 1.

In one embodiment seen in FIGS. 1-3, the intermediate layer 40 is a sheet of material sandwiched between, and substantially coextensive with, the lower and upper sheets 20 and 30. The sheets 20 and 30 may be, but are not necessarily, of the same flexible impervious material. The lower, intermediate and upper sheets 20, 40 and 30 are welded together in laminar relationship along their peripheries 23, 43 and 33, respectively. The puncture-resistant and wear-resistant tread pads 50 extend lengthwise in a lengthwise direction of the floor 10.

Figure 4:
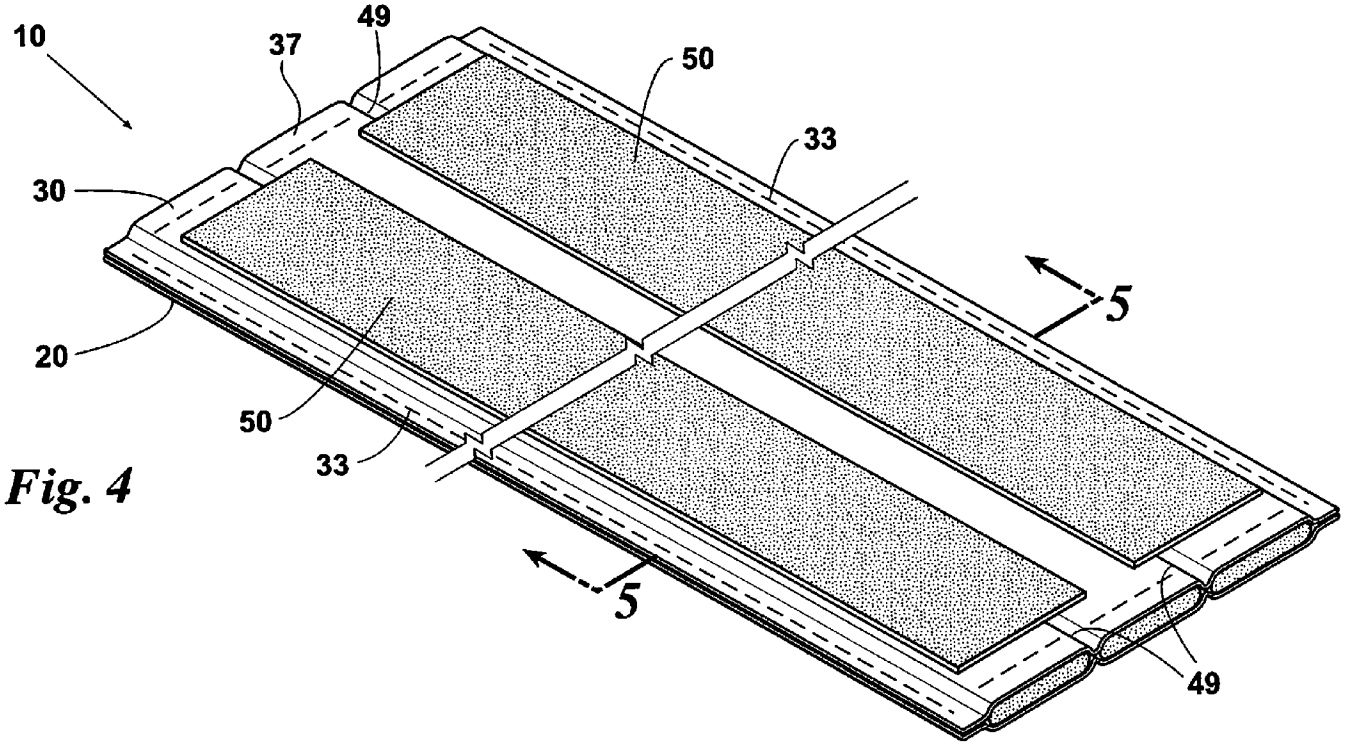
FIG. 4 is a perspective view of another embodiment of the floor of a portable containment berm in accordance with the invention.
Figure 5:
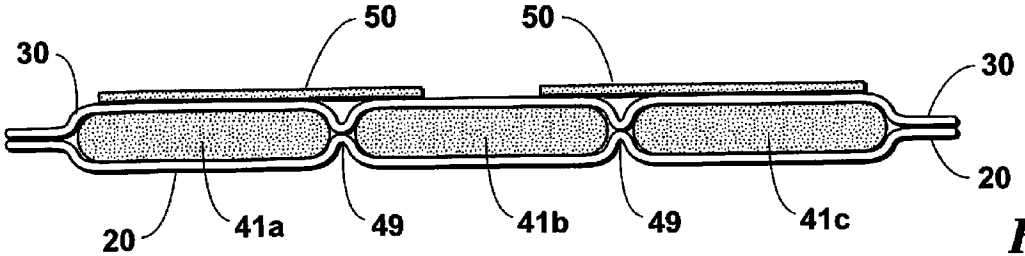
FIG. 5 is a cross-sectional view taken along the line 5-5 of FIG. 4.
Figure 6:
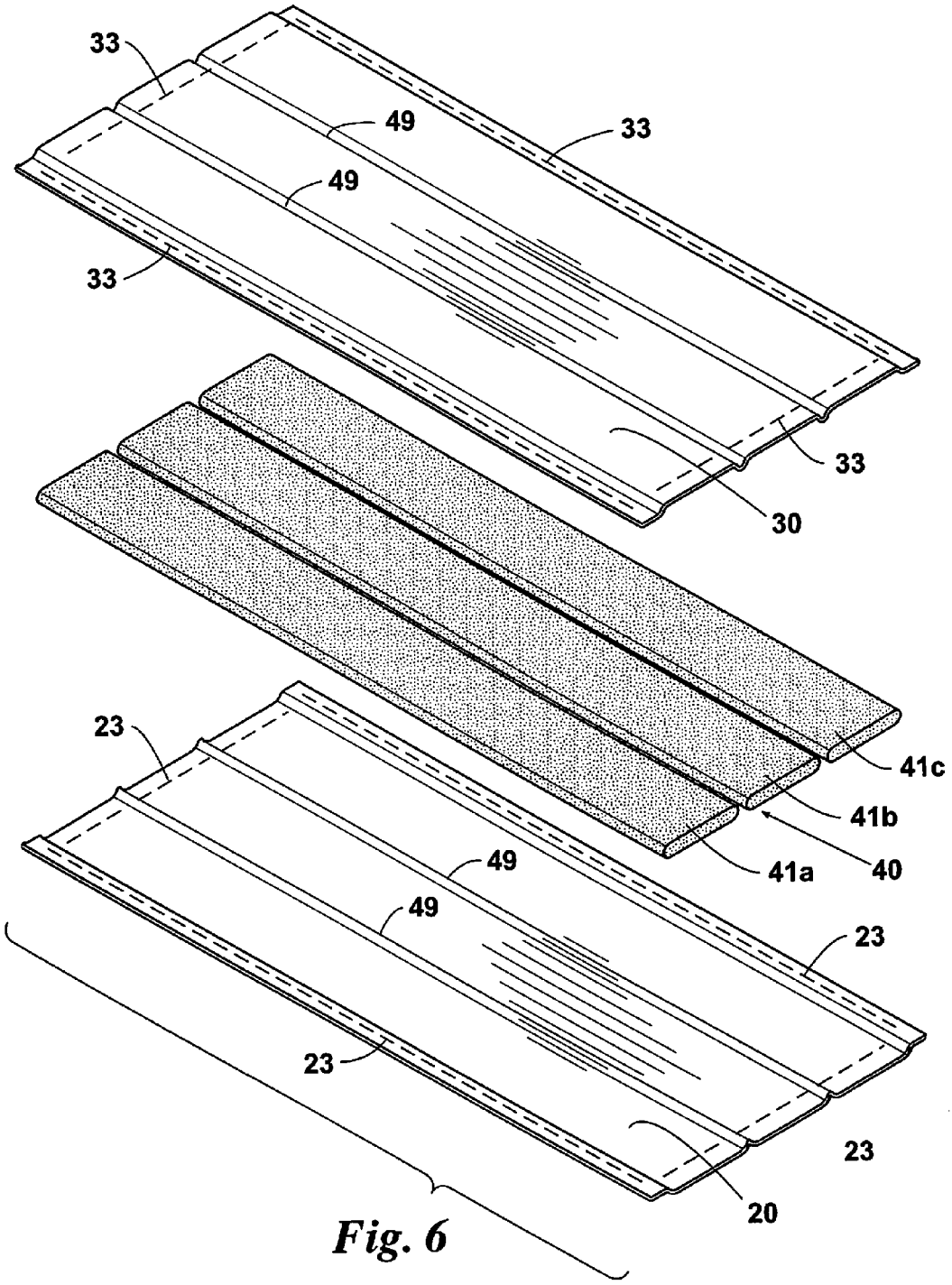
FIG. 6 is a perspective assembly view of the floor of FIG. 4.

In another embodiment seen in FIGS. 4-6, the intermediate layer 40 has at least two, and as shown three, belts 41*a*, 41*b* and 41*c* of flexible puncture-resistant material extending lengthwise in a lengthwise direction of the lower and upper sheets 20 and 30 of flexible impervious material. The lower and upper sheets 20 and 30 are welded together in laminar relationship along their peripheries 23 and 33 and are also welded together in the gaps 49 between each adjacent pair 41*a*-41*b* and 41*b*-41*c* of the belts of flexible puncture-resistant material. At least one, and as shown two, puncture-resistant and wear-resistant tread pads 50 extend lengthwise in the lengthwise direction of the floor 10 and belts 41*a*, 41*b* and 41*c* of flexible puncture-resistant material.

A "flexible" sheet is one that is capable of contouring, in response to the weight of a vehicle, to the supporting terrain beneath the sheet as a wheel of the vehicle traverses the berm floor. An "impervious" material is one that is capable of preventing penetration by a liquid intended to be contained by the berm. A "puncture-resistant" material is one that is capable of resisting piercing by objects likely to come into a position between the berm floor and the wheels of a vehicle traversing the floor. A "wear-resistant" pad is one that is capable of delaying the deterioration of the berm floor that would otherwise result in response to its intended use. "Welding" as referred to herein includes any process by which the components of the floor can be secured to each other without compromising the "impervious" quality of a component said to be impervious, and may for example include thermal or dielectric processes.

By way of example, a suitable 80'×12' floor 10 according to the embodiment of FIGS. 1-3 for a berm to be used for the purpose of secondary containment and spills in relation to motorized and/or tracked vehicles or trailers could be assembled using 80'×12'×0.035" sheets 20 and 30, an 80'×12'×0.125" sheet 40 and 80'×4'×0.024" pads 50. Also by way of example, a suitable floor 10 according to the embodiment of FIGS. 4-6 for a berm to be used for the same purpose could be assembled using 80'×12'×0.035" sheets 20 and 30, 78'×3'×0.125" belts 40 and 78'×4'×0.024" pads 50. All of the sheets, belts and pads may, for example, be ethylene interpolymer alloys. Typically, berm floors 10 will be in a range of 10 to 80 feet long by 6 to 20 feet wide, belts 50 will be spaced approximately 2 to 6 inches apart and pads will be of width and number suited to accommodate the wheels of a vehicle traversing the berm floor 10. The strengths of materials used will be selected according to the anticipated load on the berm floor 10.

Thus, it is apparent that there has been provided, in accordance with the invention, a floor for a portable containment berm that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A floor for a portable containment berm comprising:

a lower sheet of flexible impervious material;

an upper sheet of flexible impervious material;

an intermediate layer of flexible puncture-resistant material between said lower and upper sheets of flexible impervious material, said intermediate layer comprising a sheet of flexible puncture-resistant material substantially coextensive with said lower and upper sheets of flexible impervious material;

said lower, intermediate and upper sheets being welded in laminar relationship along their peripheries; and at least one puncture-resistant and wear-resistant tread pad fixed to a top surface of said upper sheet of flexible impervious material by welding.

2. A floor for a portable containment berm comprising:

a lower sheet of flexible impervious material;

an upper sheet of flexible impervious material;

an intermediate layer of flexible puncture-resistant material between said lower and upper sheets of flexible impervious material, said intermediate layer comprising at least two belts of flexible puncture-resistant material extending lengthwise in a lengthwise direction of said lower and upper sheets of flexible impervious material; and at least one puncture-resistant and wear-resistant tread pad fixed to a top surface of said upper sheet of flexible impervious material;

said lower and upper sheets being welded in laminar relationship along their peripheries and between each adjacent pair of said at least two belts of flexible puncture-resistant material.

3. A floor according to claim 2, said at least one puncture-resistant and wear-resistant tread pad extending lengthwise in a lengthwise direction of said at least two belts of flexible puncture-resistant material.

4. A floor according to claim 3, said at least one puncture-resistant and wear-resistant tread pad being fixed to a top surface of said upper sheet of flexible impervious material by welding.

* * * * *